US007748663B1

(12) United States Patent
Craig et al.

(10) Patent No.: US 7,748,663 B1
(45) Date of Patent: Jul. 6, 2010

(54) LAUNCH VEHICLE STAGE INTEGRATION DEVICE

(75) Inventors: Curtis D. Craig, Carriere, MS (US); Derek A. Townsend, Slidell, LA (US); James P. Brady, Mandeville, LA (US)

(73) Assignee: Lockheed Martin Corporation, Bethesda, MD (US)

( * ) Notice: Subject to any disclaimer, the term of this patent is extended or adjusted under 35 U.S.C. 154(b) by 967 days.

(21) Appl. No.: 11/439,786

(22) Filed: May 23, 2006

Related U.S. Application Data

(60) Provisional application No. 60/684,017, filed on May 24, 2005, provisional application No. 60/795,400, filed on Apr. 27, 2006.

(51) Int. Cl.
*F42B 15/36* (2006.01)

(52) U.S. Cl. ..... 244/158.1; 102/377

(58) Field of Classification Search ..... 244/158.1, 244/173.1, 173.3, 120, 3.1, 3.24; 102/377, 102/378; 89/1.14
See application file for complete search history.

(56) References Cited

U.S. PATENT DOCUMENTS

| | | | | | |
|---|---|---|---|---|---|
| 3,277,826 | A | | 7/1965 | Silverthorne | |
| 3,229,884 | A | * | 1/1966 | Franklin et al. | 228/50 |
| 3,458,217 | A | * | 7/1969 | Pride, Jr. et al. | 285/3 |
| 3,487,781 | A | | 1/1970 | Oss | |
| 3,505,925 | A | * | 4/1970 | Carr | 89/1.1 |
| 3,641,937 | A | * | 2/1972 | Silverthorne | 102/473 |
| 3,706,281 | A | | 12/1972 | Hatakeyama | |
| 3,903,803 | A | * | 9/1975 | Losey | 102/378 |
| 4,516,499 | A | | 5/1985 | Eyman | |
| 4,715,565 | A | * | 12/1987 | Wittmann | 244/173.1 |
| 4,771,696 | A | | 9/1988 | Smolnik | |
| 5,104,070 | A | * | 4/1992 | Johnson et al. | 244/172.4 |
| 5,125,601 | A | * | 6/1992 | Monford, Jr. | 244/173.1 |
| 5,529,264 | A | | 6/1996 | Bedegrew et al. | |
| 5,593,190 | A | * | 1/1997 | Shepard | 292/98 |
| 5,979,831 | A | * | 11/1999 | Seaquist | 244/158.1 |
| 6,076,467 | A | * | 6/2000 | Cespedosa et al. | 102/378 |
| 6,227,493 | B1 | * | 5/2001 | Holemans | 244/173.1 |
| 6,289,818 | B1 | * | 9/2001 | Mueller et al. | 102/377 |
| 6,305,871 | B1 | * | 10/2001 | Lancho Doncel et al. | 403/286 |
| 6,343,770 | B2 | * | 2/2002 | Holemans | 244/173.3 |
| 6,357,699 | B1 | * | 3/2002 | Edberg et al. | 244/173.3 |
| 6,390,416 | B2 | * | 5/2002 | Holemans | 244/173.3 |
| 6,403,873 | B1 | * | 6/2002 | Amaral et al. | 114/22 |
| 6,494,407 | B2 | * | 12/2002 | Arulf | 244/173.1 |

(Continued)

OTHER PUBLICATIONS

Offer to Sale—Disclosed in Section 3 of IDS.

*Primary Examiner*—Tien Dinh
*Assistant Examiner*—Joseph W Sanderson
(74) *Attorney, Agent, or Firm*—Jones, Walker, Waechter, Poitevent, Carrere & Denegre, L.L.P.

(57) ABSTRACT

A mating and connection system for securing adjacent stages of a launch vehicle. The system includes a locking flange connected to each of a first vehicle stage and a second vehicle stage. A compression ring is positioned internal to the first and second vehicle stages. The compression ring is shaped to compress together the locking flanges of the first and second stages upon engagement with the locking flanges. A locking jack is capable of being activated from an exterior of the first and second stages and operates to selectively move the compression ring into and out of engagement with the locking flanges.

27 Claims, 8 Drawing Sheets

U.S. PATENT DOCUMENTS 6,648,543 B2 * 11/2003 Arulf ..... 403/334
6,679,177 B1 1/2004 Wu et al.
6,712,542 B2 * 3/2004 Buder ..... 403/374.2
6,820,559 B1 11/2004 Comtesse
7,503,523 B2 * 3/2009 Perez-Sanchez ..... 244/129.4
2005/0116088 A1 6/2005 Telford et al.
2006/0145016 A1 * 7/2006 Renfro ..... 244/158.1
2007/0080260 A1 * 4/2007 Lancho Doncel ..... 244/173.1

* cited by examiner

LAUNCH VEHICLE STAGE INTEGRATION DEVICE

CROSS-REFERENCE TO RELATED APPLICATION

This application claims the benefit under 35 USC 119(e) of provisional application Ser. Nos. 60/684,017 filed May 24, 2005 and 60/795,400 filed Apr. 27, 2006, both of which are incorporated by reference herein in their entirety.

STATEMENT REGARDING FEDERALLY SPONSORED RESEARCH AND DEVELOPMENT

This invention was developed in part with funds from contract no. HR0011-040C-0020 awarded by the Defense Advanced Research Projects Agency and the U.S. Government may have certain rights to the invention as provided by that contract.

BACKGROUND OF INVENTION

The present invention relates to launch vehicles employed in aerospace applications and more particularly, to methods and apparatuses employed in mating separate stages of such launch vehicles.

In the aerospace industry, launch vehicles such as rockets are often divided into multiple segments or "stages." Typically, the stages will consist of one or more engine or motor stages, a payload stage, and other optional stages depending on the mission of the launch vehicle. In some launch vehicles, the payload stage will include a first mechanism for connecting the payload stage to the other vehicle stages prior to launch. This mechanism is intended for connecting and disconnecting the payload stage in preparation for launch and may not be intended for separating the payload while the vehicle is in flight. In these types of launch vehicles, typically a different payload separation or payload deployment mechanism, such as a pyrotechnic separation device, is intended to deploy the payload after the vehicle has reached the intended altitude and position in or above the atmosphere.

Many launch vehicles, particularly "smaller" launch vehicles (e.g., intended to carry a payload of less than 5000 lbs. into the atmosphere) are designed to be readily transportable on land vehicles such as trucks and/or trailers and are intended to be launched at remote sites having little or no special preparation for launch operations. To facilitate transportation, it is often advantageous to transport different stages of the launch vehicle on separate land vehicles, thereby reducing the required size of the land vehicles. Once the launch vehicle arrives at the intended launch site, it is often desirable to prepare the launch vehicle for operation as quickly as possible. One component of this preparation is connecting all of the stages quickly and with a minimum of manpower and special equipment.

In certain instances, it may be particularly efficient to connect the stages together while the stages are still in a substantially horizontal position (e.g., while the stages are still on their land transport vehicles). There is a need in the art for devices which allow for more rapid and efficient assembly of the stages in multiple stage launch vehicles.

SUMMARY OF SELECTED EMBODIMENTS OF INVENTION

One embodiment of the present invention comprises a launch vehicle having a plurality of stages, wherein at least two of said stages are connected by a mating system. The mating system includes a locking flange connected to each of a first vehicle stage and a second vehicle stage. A compression ring is positioned internal to the first and second vehicle stages. The compression ring is shaped to compress together the locking flanges of the first and second stages when engaged with the locking flanges. A locking jack is positioned internal to the first and second vehicle stages. The locking jack is capable of being activated from an exterior of the first and second stages and the locking jack operates to selectively move the compression ring into and out of engagement with the locking flanges.

Another embodiment of the present invention includes a method of mating and locking two stages of a launch vehicle. The method involves providing a first vehicle stage and a second vehicle stage, wherein each of said vehicle stages includes a locking flange. The first and second vehicle stages are positioned adjacent to one another while in a substantially horizontal orientation. Then the first and second vehicle stages are moved into contact and the locking flanges are engaged with a compression ring positioned internal to the first and second vehicle stages. The compression ring is shaped to compress together the locking flanges of the first and second stages.

DETAILED DESCRIPTION OF INVENTION

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
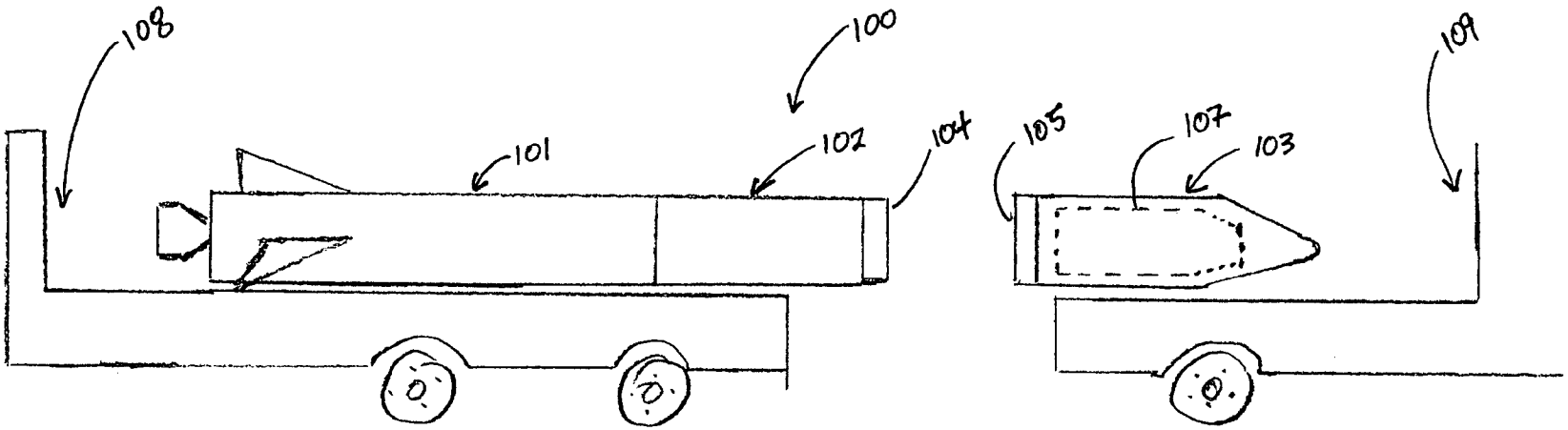
FIG. 1 illustrates different stages of a launch vehicle positioned on ground transport vehicles.

FIG. 1 generally illustrates a launch vehicle 100 having multiple stages 101, 102, and 103. In this particular embodiment, stage 101 is the main engine stage, stage 102 the secondary engine stage, and stage 103 the payload stage having a payload 107 such as a satellite or munitions package. As used herein, "stage" means any separable section of the launch vehicle, regardless of whether that section is an engine section, payload section or a section that serves any other purpose. In FIG. 1, stages 101 and 102 are mounted on ground transport vehicle 108 while payload stage 103 is mounted on ground transport vehicle 109. Ground transport vehicles 108 and 109 may be any type of trailer, truck, or combination thereof. It will be understood that to complete the assembly of launch vehicle 100, the head end 104 of stage 102 and the tail end 105 of stage 103 must be connected or mated together. The structure for connecting these stages are the subject of the embodiments shown in FIGS. 2 through 8.

Figure 2:
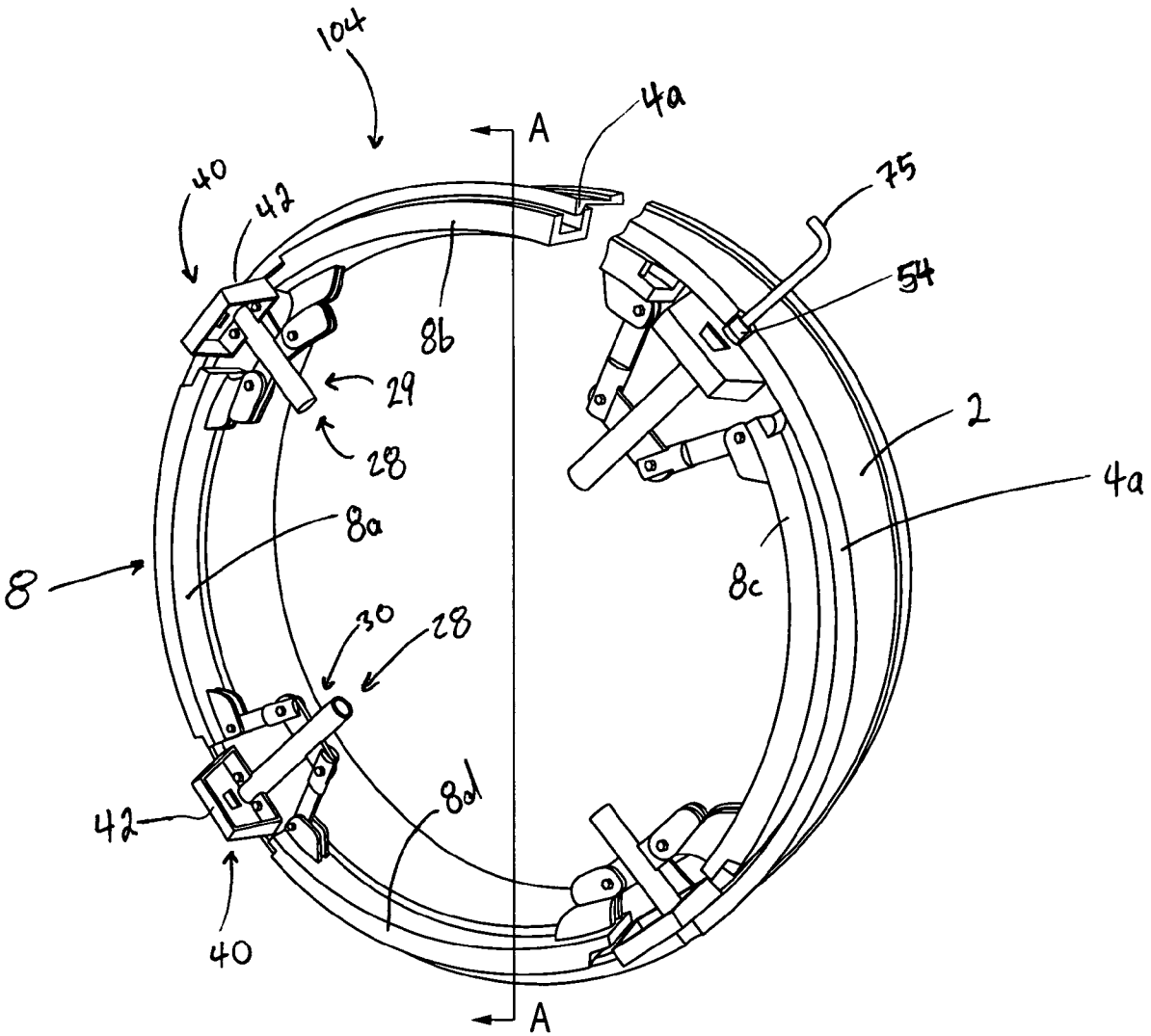
FIG. 2 illustrates a first section of one embodiment of the stage mating system of the present invention.
Figure 3:
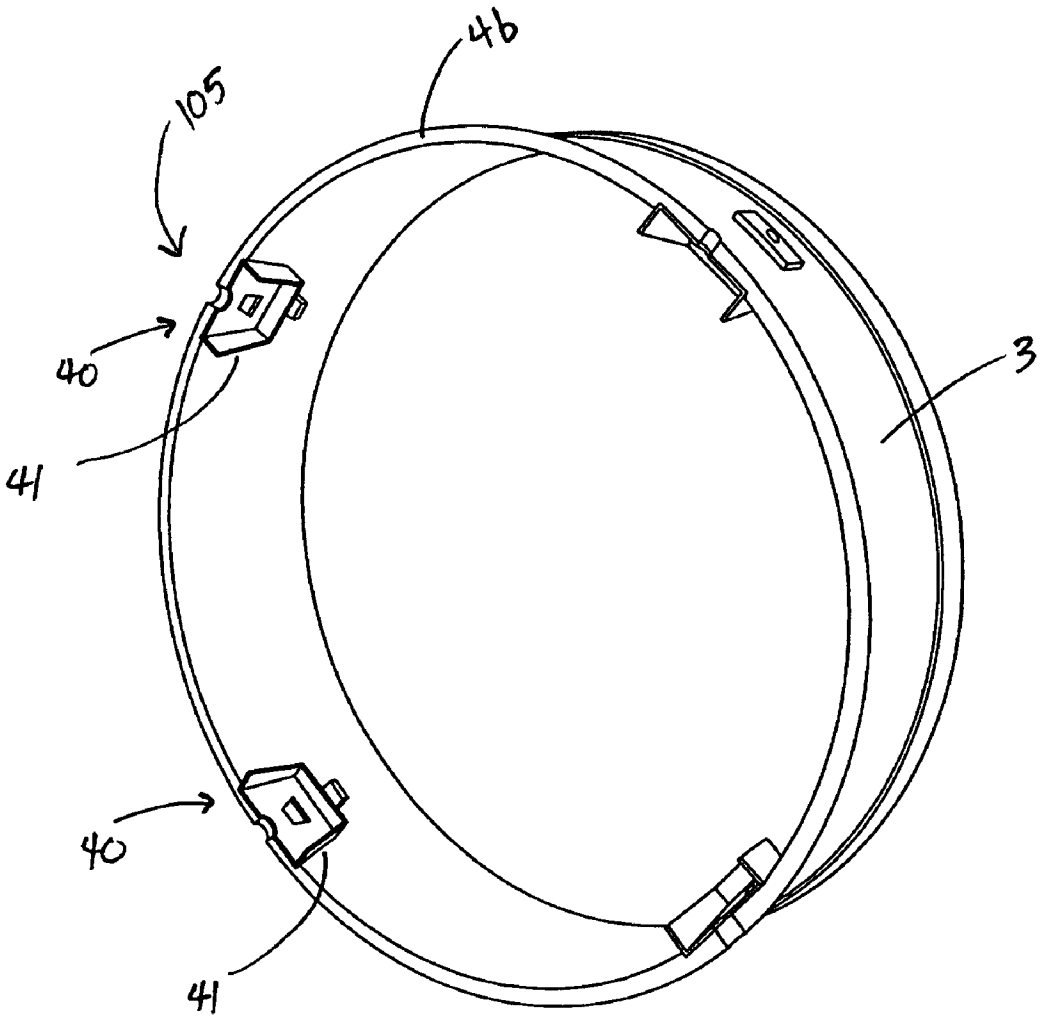
FIG. 3 illustrates a second section of the embodiment of the stage mating system seen in FIG. 2.

FIG. 2 illustrates head end 104 of stage 102 seen in FIG. 1 while FIG. 3 illustrates the tail end 105 of stage 103. For the sake of simplicity, the entirety of stages 102 and 103 are not shown and only a portion of the body 2 of stage 102 and a portion of body 3 of stage 103 are illustrated in FIGS. 2 and 3. The components shown in FIG. 2 which generally make up this embodiment of the mating and alignment system 1 comprise locking flange 4*a*, compression ring 8, and locking jacks 28. It can be seen in FIG. 3 that tail end 105 of stage 103 includes a separate locking flange 4*b*.

In the embodiment seen in FIG. 2, the compression ring 8 is a "ring" in the sense that it generally extends along the circumference of the head end of the vehicle stage. Compression ring 8 is typically not a continuous ring and may be broken into multiple arcs or ring segments. Therefore, the term "ring" as used herein is intended to mean either a continuous ring or a series of arcuate segments positioned along the circumference of the head end (or tail end as the case may be) of the stage. There is no set percentage of the circumference which must be covered by the various segments of compression ring 8. Generally, at least 25%, 50%, or 75% of the circumference will be covered by compression ring 8. FIG. 2 illustrates four ring segments 8*a*, 8*b*, 8*c*, and 8*d* which cover the circumference of head end 104 except where interrupted by locking jacks 28. Naturally, other embodiments could divide compression ring 8 into fewer or more ring segments, such as two, three, five, six, or even more ring segments. Although locking flanges 4*a* and 4*b* are shown as continuous flanges around the stage's circumference in the Figures, the locking flanges 4*a* and 4*b* could likewise appear in multiple segments and need not be a continuous ring. Locking flanges 4*a* and 4*b* may be separate flanges fixed (e.g., by bolting or welding) to the stage ends or may be integrally formed on the stage ends.

Figure 4A:
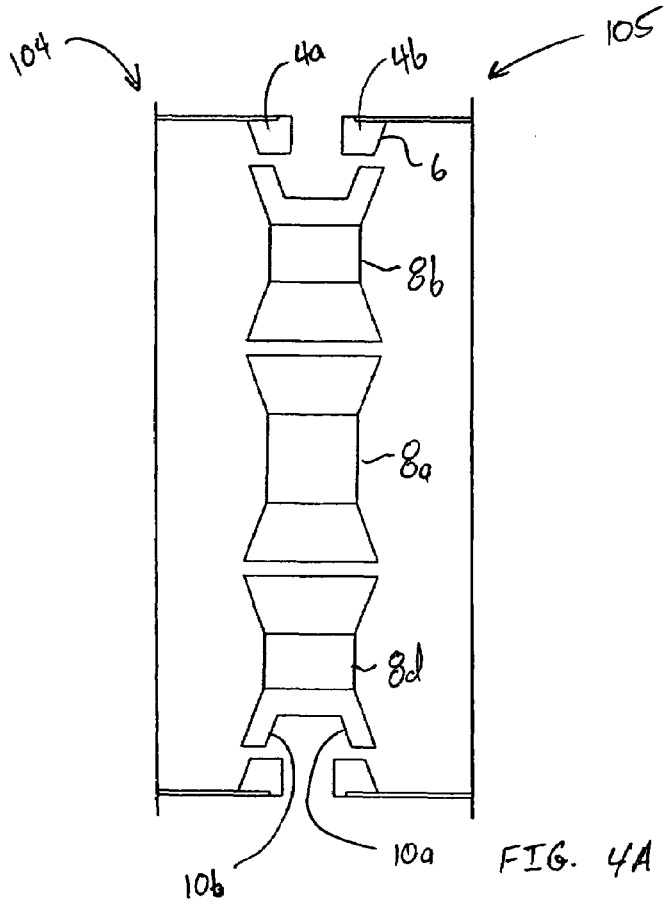
FIGS. 4A and 4D illustrate sectional view of the locking flanges and compression ring of the embodiment seen in FIGS. 2 and 3.
Figure 4B:
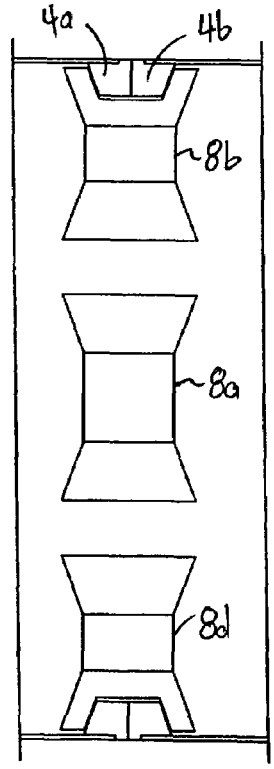

The actual shape of locking flanges 4*a* and 4*b* along with compression ring 8 is best seen in the schematic cross-sectional view of FIGS. 4A and 4B (shown with locking jacks 28 removed) and the cutaway section of FIG. 2. FIG. 4A illustrates head end 104 of a first stage and tail end 105 of a second stage being moved together, but not yet in contact. It can be seen that the locking flanges 4*a* and 4*b* on each stage includes an inclined surface 6. The surface of compression ring segments 8*a*-8*d* which face inclined surfaces 6 of locking flanges 4*a* and 4*b* will be channel shaped with a trough and upwardly extending inclined side surfaces 10*a* and 10*b*. When compression ring segments 8*a*-8*d* are in a retracted position (i.e., positioned closer the center point of the vehicle stage and thus away from the locking flanges), locking flanges 4*a* and 4*b* may come together without encountering the compression ring segments. Once locking flanges 4*a* and 4*b* are sufficiently close together, compression ring segments 8*a*-8*d* will extend (by operation of locking jacks 28 as described below) away from the vehicle stage center point and toward the locking flanges 4*a* and 4*b* in order to engage the locking flanges as suggested in FIG. 4B. It can be seen that the inclined surfaces 10 on compression ring 8 engage the inclined surfaces 6 on locking flanges 4*a* and 4*b*, thus securely forcing together and holding together the locking flanges and consequently the stages to which the locking flanges are attached. The inclined surfaces on compression ring 8 and locking flanges 4*a* and 4*b* may be sized such that the further compression ring 8 moves radially outward from the stage center point, the greater the force applied in holding locking flanges 4 together. Although the Figures show compression ring 8 as generally channel shaped with inclined side surfaces 10 and locking flanges 4 having complementary inter-acting inclined surfaces, it will be understood that the present invention encompasses all variations of interacting surfaces which tend to draw the locking flanges 4 together when acted upon by compression ring 8. As one nonlimiting example, compression ring 8 could have a surface which is more of a "V" shape than the channel shape seen in the Figures.

In the embodiment of FIG. 2, two different types of locking jacks 28 are shown, pivot jacks 29 and compression jacks 30. As best understood in conjunction with the schematic cross-sectional illustration of FIG. 5A, compression jacks 30 are generally formed of jack body 31 which is a generally tubular member which is fixed relative to one of the stage bodies (not shown in FIG. 5). FIG. 6 illustrates one method by which jack body 31 may be fixed to stage body 2. In this example, a triangular shaped backing plate 57 is attached to jack body 31 (e.g., by bolting in FIG. 6, but could include any other fastening means). A triangular gusset 55 attaches along one of its sides to backing plate 57 and then gusset 55 is attached to stage body 2 along another of gusset plate 55's sides. In this particular embodiment, gusset plate 55 is indirectly attached to stage body 2 via its attachment to a structural support 56. The connections between backing plate 57, gusset plate 55, and stage body 2 may be by welding, bolting, or any other fastening means). Although not explicitly shown, pivot jacks 29 may be attached to the stage body in a similar manner. This is simply one manner of attaching jacks 28 to the relevant stage and any number of different methods could be employed.

Returning to FIG. 5A, it will be understood that a slot is formed in jack body 31 which allows the traveling link 34 to move up and down relative to jack body 31. A drive member 32 will engage traveling link 34 in such a way that drive member 34 may control the up and down position of traveling link 34. In the embodiment shown, drive member 32 is a bolt 54 whose threads engage corresponding threads formed through traveling link 34 and whose head engages the base of jack body 31. Thus turning bolt 54 clockwise or counter-clockwise will cause traveling link 34 to move upwards or downwards. Pinned to each end of traveling link 34 are two intermediate links 35, which are in turn pinned to base lugs 36. Base lugs 36 are rigidly fixed to respective compression ring segments 8*b* and 8*c*. It can be seen that as traveling link 34 moves downward (toward the base of jack body 31), intermediate links 35 will move base lugs 36 (and thus pressing ring segments 8*b* and 8*c*) downward. When the jack and compression ring segments are oriented such as seen in FIG. 2, this movement of traveling link 34 will move the compression ring segments away from the center point of the stage body and toward engagement with locking flanges 4. Likewise, the turning of the bolt 54 in the opposite direction will cause traveling link 34 to move upward (toward the center point of the stage body) and cause ring segments 8*b* and 8*c* to move out of engagement with locking flanges 4.

Figure 5A:
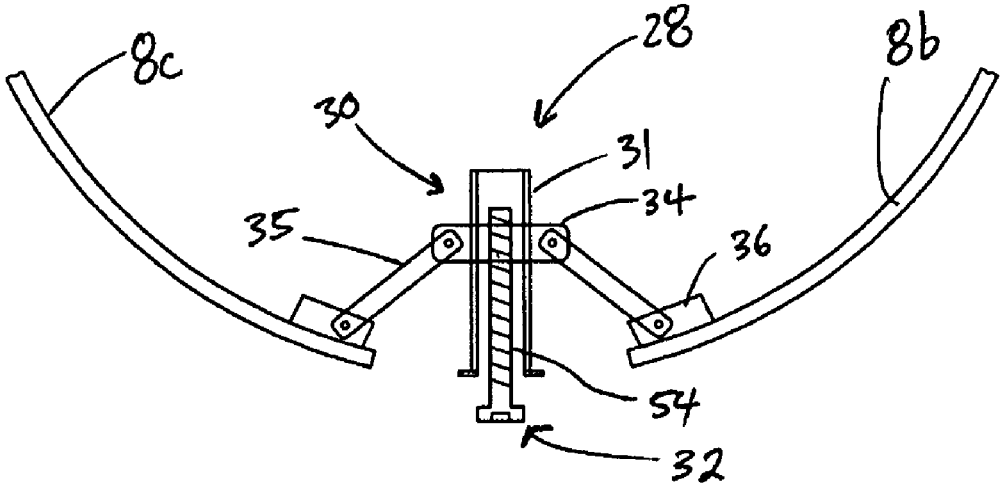
FIGS. 5A and 5B illustrate two embodiments of jacks which could be employed in the present invention.
Figure 5B:
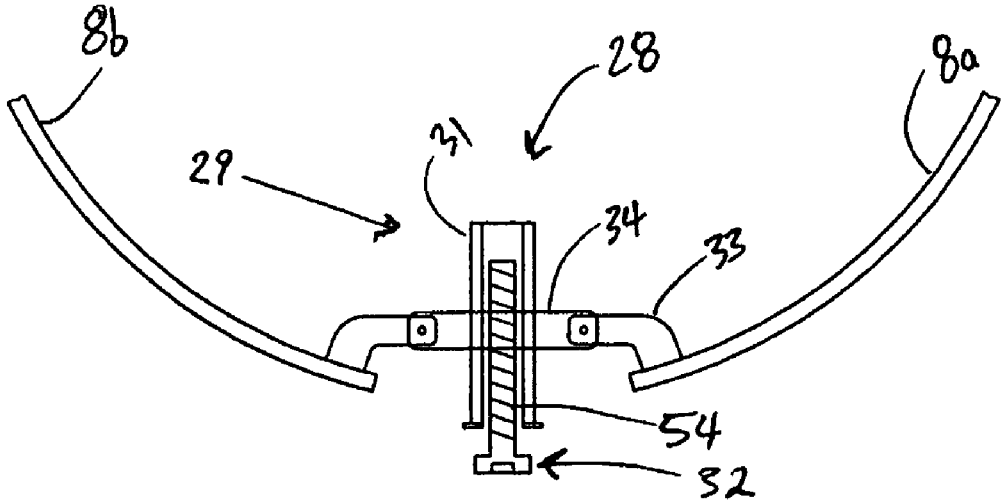
Figure 6:
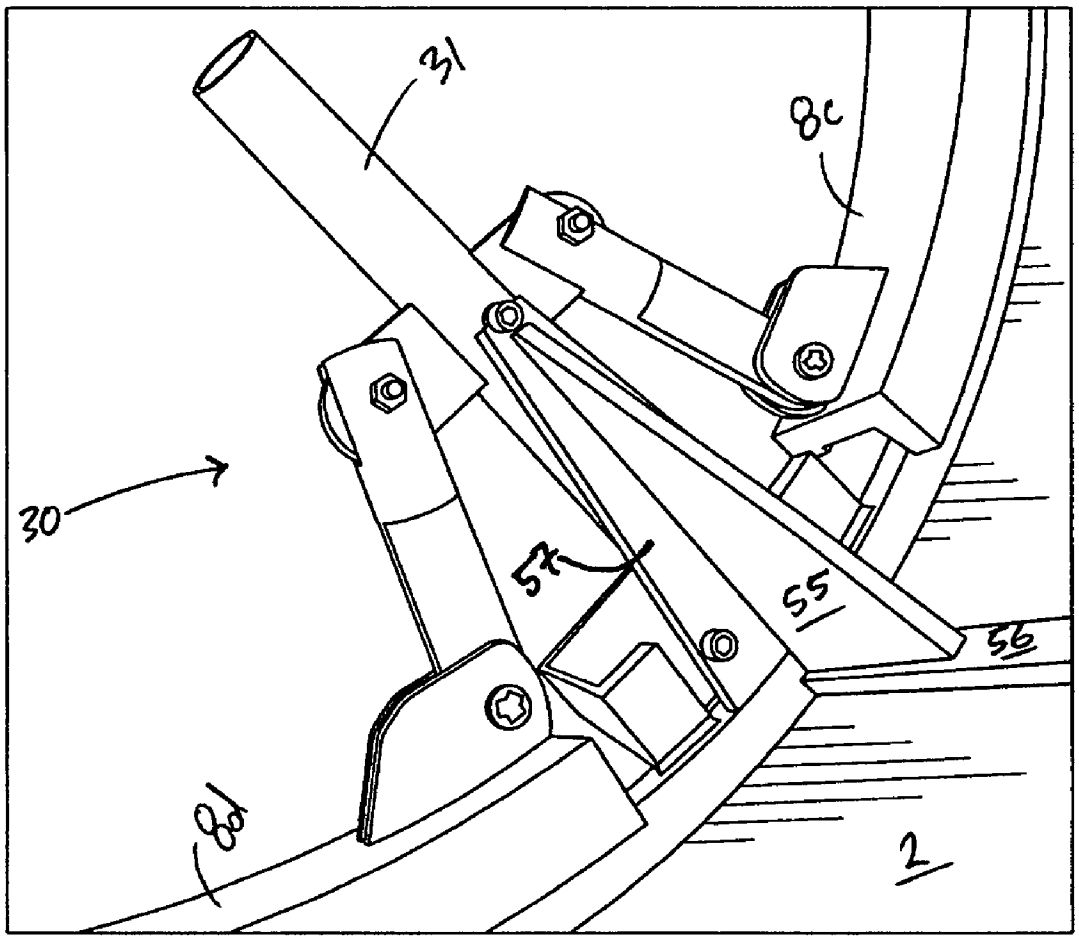
FIG. 6 illustrates how one type of jack could be secured to one of the launch vehicle's stages.

A schematic cross-sectional view of pivot jack 29 is seen in FIG. 5B. Pivot jack 29 is similar to compression jack 30 in that pivot jack 29 has a jack body 31 fixed to a stage body as described above. Likewise, pivot jack 29 has a similar drive member 32 (bolt 54) engaging a traveling link 34. However, rather than engaging an intermediate link, the traveling link 34 of pivot jack 29 is pinned to opposing L-shaped legs 33 which are rigidly attached to compression ring segments 8*a* and 8*b*. It can visualized how the turning of bolt 54 will cause traveling link 34 to move up or down (depending on the direction of bolt 54's rotation) and thereby cause compression ring segments 8*a* and 8*b* to move in the same general direction as traveling links 43. Similarly as described for compression jacks 30, this will cause compression ring segments 8*a* and 8*b* to move into and out of engagement with locking flanges 4. The embodiment of FIG. 2 shows two compression jacks 30 and two pivot jacks 29 positioned alternatively, thus allowing one end of each compression ring segment to be acted upon by a pivot jack 29 and the other end to be acted upon by a compression jack 30. In this embodiment, the 2/2 ratio of compression and pivot jacks helps stabilize the compression ring. The pivot jack 29 is a single pined connection and provides a more rigid pivot point. The compression jack 30 has a link which helps compress the ring 8 on top of the locking flanges 4 and tends to have somewhat more tolerance. Pivot jacks 29 also allow elimination one set of links and tends to make the system somewhat simpler. However, other arrangements (e.g., all compression jacks 30 or all pivot jacks 29) are certainly within the scope of the present invention.

Naturally, the present invention is not limited to the jacks 29 or 30 shown in the Figures. Any device capable of moving the compression ring segments into and out of engagement with the locking flanges should be considered a type of "jack" and is intended to be encompassed by the present invention. Similarly, FIG. 2 shows the jacks (and compression ring 8) on stage 104, but the jacks and compression ring could just as readily be positioned on the opposing stage. As suggested in FIG. 2, the illustrated embodiments show the end of bolt 54 extending through the wall of stage body 2 such that it may be engaged by wrench 75 from the exterior of the launch vehicle. And while FIG. 2 shows bolt 54 positioned along the edge where the two stages meet, other embodiments could have bolt 54 positioned further back from the edge of the stage.

Figure 7A:
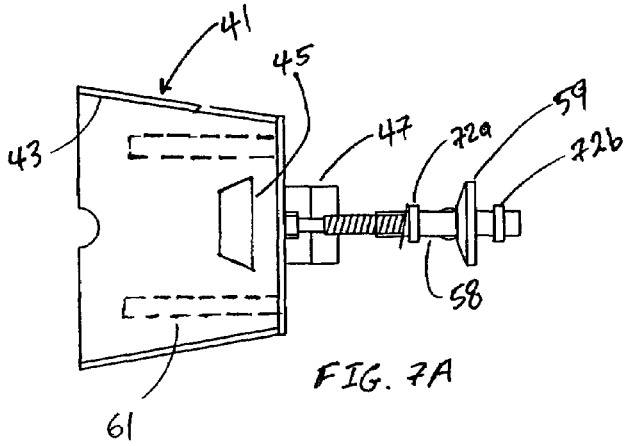
FIGS. 7A to 7C illustrate one embodiment of a channel section used in the alignment guides.
Figure 7B:
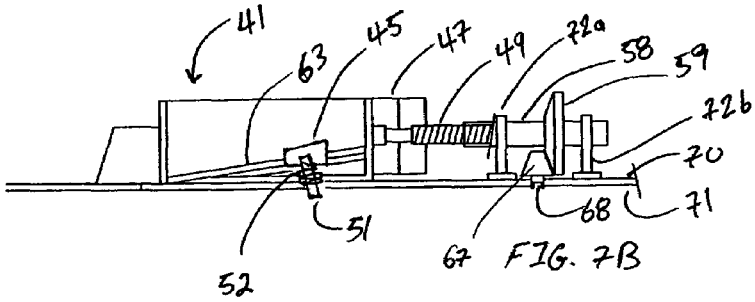

The launch vehicle stage mating and alignment system seen in the Figures also includes the alignment guides 40 seen in FIGS. 2 and 3. This embodiment of alignment guides 40 includes two parts, channel section 41 (FIG. 3) on tail end 105 of stage 103 and tongue section 42 (FIG. 2) on head end 104 of stage 102. Although tongue sections 42 are shown positioned in front of jacks 28, other embodiments could position jacks 28 elsewhere along the circumference of the stage edge. As better seen in FIGS. 7A to 7C, channel section 41 includes inwardly tapering side walls 43 and an upwardly inclined bottom wall 63 (FIG. 7B). Positioned in bottom wall 63 is a latch member 45 which is capable of extending above and retracting below bottom wall 63 in order to engage and disengage catch 46 on tongue section 42 (see FIG. 8A). In the embodiment shown, latch 45 may have a tapered front surface to more easily engage tongue section 42 as described in more detail below. As best seen in FIG. 7B, latch member 45 will have a spring 52 which biases latch member 45 in an upward position (i.e., extending above bottom wall 63). A retraction screw 51 is positioned below latch member 45 and is capable of engaging and pulling latch member 45 downward when it is desired to move latch member 45 below bottom wall 63. It can be seen that retraction screw 51 extends through to the outer surface 71 of the stage wall, thus allowing screw 51 to be rotated and latch member 45 to be retracted from the exterior of the launch vehicle.

Figure 7C:
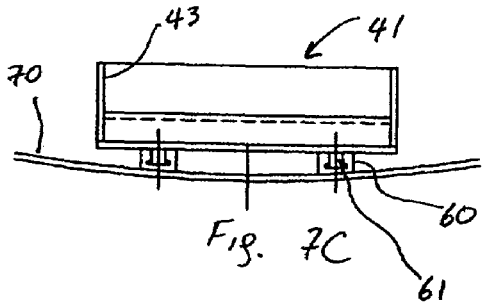

As seen in the embodiment of FIG. 7C, channel section 41 may have T-rails 61 attached to its bottom surface which engage corresponding T-slots 60 attached to the inner surface 70 of the stage wall. This slot and rail arrangement allows channel section 41 to slide backwards and forwards along the longitudinal axis of the launch vehicle (i.e., left and right in FIG. 7B). To control this backwards and forwards movement, a traveling block 47 is fixed to the rear of channel section 41. An axial screw 49 is attached to, but free to rotate within, traveling block 47. Movement of axial screw 49 may be controlled by a conventional bevel and pinion gear arrangement. FIG. 7B illustrates a tubular shaft 58 having internal threads which engage axial screw 49. Support posts 72*a* and 72*b* are attached to the inside surface 70 of the stage wall and have apertures through which tubular shaft 58 is rotatably positioned (i.e., tubular shaft 58 is allowed to rotate on support posts 72*a* and 72*b*). Fixed to tubular shaft 58 is bevel gear 59. A pinion gear 67 meshes with bevel gear 59 such that rotation of pinion gear 67 causes rotation of bevel gear 59. A pinion shaft 68 extends through the stage wall and has a tool head which can be engaged by an allen wrench, screw driver, or similar tool at the external surface 71 of the stage wall. Thus, it can be seen that rotation of pinion shaft 68 causes rotation of bevel gear 59 (and tubular shaft 58) which in turn will cause axial screw 49 to move toward or away from (depending on direction of shaft 58's rotation) bevel gear 59, thereby moving channel section 41 in the same direction as axial screw 49. In this manner, channel section 41 may be moved back and forth from the exterior of the launch vehicle. Of course, the illustrated mechanism for adjusting the position of channel section 41 is just one example of how channel section 41 may be adjusted from the exterior of the launch vehicle and any number of alternative mechanisms may be used and should be considered within the scope of the present invention. For example, a worm gear could alternatively be employed to rotate axial gear 49 and adjust the position of channel section 41.

Figure 8A:
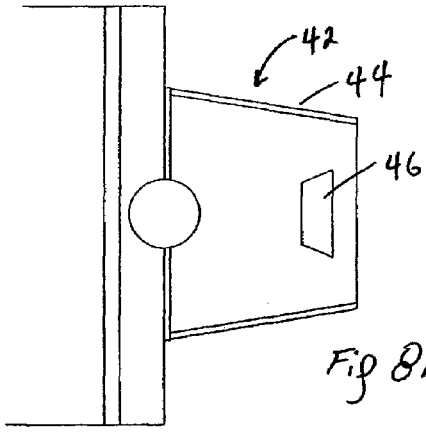
FIGS. 8A and 8B illustrate one embodiment of a tongue section used in the alignment guides.
Figure 8B:
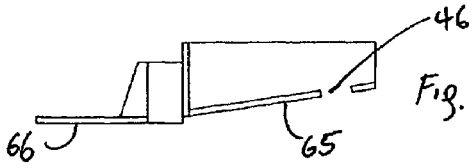

FIGS. 8A and 8B illustrate the tongue section 42 which is positioned on the head end 104 of stage 102 in FIG. 2. Tongue section 42 will comprise tapered side flanges 44 which generally correspond in angle with tapered side walls 43 of channel section 41. Additionally, tongue section 42 will include a catch 46 positioned on bottom wall 65 and which is shaped to be engaged by latch 45 (FIG. 7B). In the embodiment shown, catch 46 is an aperture having the same general shape as latch 45. As best seen in FIG. 8B, bottom wall 65 will be inclined upward to correspond with the slope of bottom wall 63 on channel section 41. A connecting plate 66 will be used to secure tongue section 42 to the inner wall at the head end 104 of stage 102.

Returning to FIGS. 1 to 3, it can be visualized how the tail end 105 of stage 103 and the head end 104 of stage 102 can be brought together and securely connected. The two stages will be generally aligned and rotated such that the tongue sections 42 on head end 104 stage 102 will engage the channel sections 41 on the tail end 105 of stage 103. It can be seen in FIGS. 7 and 8 how the comparatively wide front opening of channel section 41 and the comparatively narrow nose of tongue section 42 allow these two sections to not be perfectly aligned and yet still engage one another. Once tongue section 42 begins to engage channel section 41, one of the inclined side flanges 44 will come into contact with the corresponding sidewall 43 of channel section 41. As tongue section 42 proceeds into channel section 41, the interaction of side flanges 44 and side walls 43 insure that tongue section 42 will ultimately be centered in channel section 41. In this manner, alignment guides 40 may be considered "self-aligning" in the rotational direction in that they ensure that the two stages will be in proper rotational alignment relative to one another once the tongue and channel sections are fully engaged. As the tongue sections 42 proceed further into channel sections 41, latch mechanisms 45 will be depressed by the lead edge of tongue sections 42 and catch apertures 46 will slide over latch mechanisms 45, which will be biased upward and will fully engage catch apertures 46 as catch apertures 46 become centered over latch mechanisms 45.

It can also be seen that the inclined bottom walls 63 and 65 will act in much the same way if the tongue section 42 and channel section 41 are slightly out of vertical alignment when the two sections are initially brought together. It will be understood that these two "self-aligning" features will be advantageous if one or both of the stages have become slightly "out-of-round." For example, if a vehicle stage has been stored on its side for a long period of time, its cross-sectional shape may have become slightly elliptical as opposed to remaining perfectly round. Thus, the inclined bottom walls 63 and 65 will force the stages "into round" as they come together and can be described as self aligning in the radial direction. Correct alignment in the rotation and radial direction may be particularly important in instances where various electrical and fluid connections between the two stages must be closely aligned in order to properly mate.

Of course, once latch 45 engages catch 46, the tongue and channel sections also provide proper alignment in the axial direction (i.e., the axis running along the length of the vehicle). With latch 45 engaging catch 46, the head end 104 may be brought even closer to tail end 105 (if necessary) using axial screws 49 as seen in FIG. 7A. The personnel assembling the launch vehicle will engage and rotate pinion shaft 68 with an appropriate tool, which will then move channel section 41 further toward the head end of the launch vehicle. Since channel section 41 is now connected to vehicle stage 102 (via tongue section 42), this rotation of axial screws 49 will urge the head end 104 closer together with tail end 105 until the locking flanges 4 are in contact or very near to being in contact.

Figure 9A:
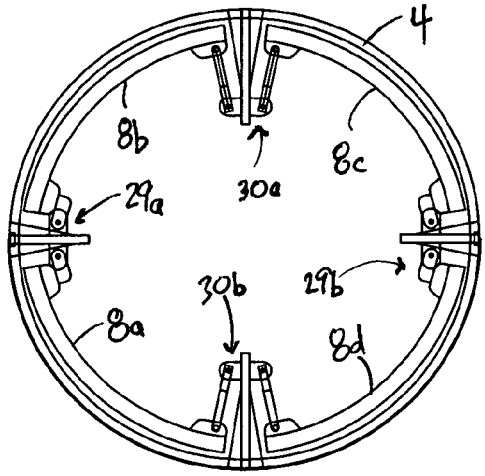
FIGS. 9A to 9C illustrate a sequence of steps in one embodiment as the compression ring segments move to engage the locking flanges.
Figure 9B:
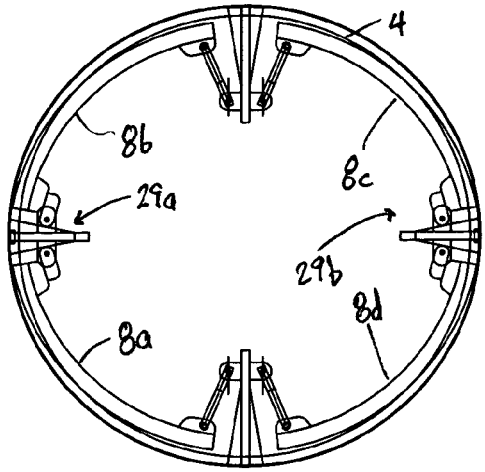
Figure 9C:
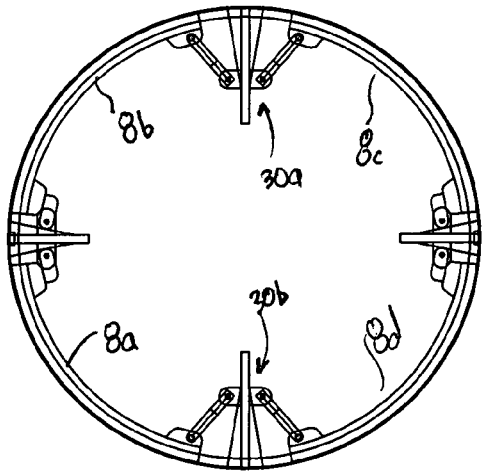

Once the alignment guides 40 have brought the locking flanges 4 together, the locking jacks will be engaged by rotating bolt 54 (FIGS. 5A and 5B), which causes the compression ring segments 8*a*-8*d* to move toward and engage locking flanges 4 as suggested in FIG. 5B. The inclined surfaces 10 on the compression ring segments 8 can exert a variable degree of clamping force on the locking flanges 4 depending on how far along the flange inclined surfaces 6 the compression ring inclined surfaces 10 are forced by locking jacks 28. FIGS. 9A to 9C illustrate one locking sequence as compression ring segments 8 move to engage the locking flanges 4 (i.e., the locking flange on each of the two stage sections). In FIG. 9A, the compression ring segments 8*a* to 8*d* are not engaging locking flanges 4. In FIG. 9B, pivot jacks 29*a* and 29*b* are activated to push the ends of the compression ring segments to which the pivot jacks are attached into engagement with locking flanges 4. Next, in FIG. 9C, compression jacks 30*a* and 30*b* are activated and push their respective ends of the compression ring segments into full engagement with locking flanges 4. At this point, the two stages are fully secured together.

If it is necessary to access the payload or place a different payload stage on the launch vehicle, rapid and efficient disengagement of adjacent stages is accomplished by reversing the connecting process. Rotating bolts 54 in the locking jacks 28 in the opposite direction will move compression ring segments 8 out of engagement with locking flanges 4. Thereafter, the transverse screw 51 is used to disengage latch 45 from catch 46 (see FIGS. 7B and 8A) and the two vehicle stages will be free to separate.

Although certain specific embodiments of the invention have been described above, many variations will be readily apparent to those skilled in the art. For example, while the Figures illustrate connection of two stages in a horizontal position, the present invention could likewise be used to connect stages positioned vertically or at some angle between horizontal and vertical. Moreover, while the Figures illustrate the compression ring on the inside of the launch vehicle, other embodiments might position the compression ring so that it is either wholly or partially on the outside of the vehicle. Likewise, use of the connecting system is not limited to connections between the payload stage and its adjacent stage, but could form the connection between any two stages making up the launch vehicle. These and all other obvious variations of the above described embodiments are intended to come within the scope of the present invention.

We claim:

1. A launch vehicle alignment system comprising:

a. a first vehicle stage and a second vehicle stage, each of said vehicle stages including a locking flange;

b. a compression ring positioned internal to said first and second vehicle stages, said compression ring being shaped to compress together said locking flanges of said first and second stages upon engagement with said locking flanges; and c. at least one locking jack positioned internal to said compression ring, said at least one locking jack capable of being activated from an exterior of said first and second stages, said at least one locking jack operating to selectively move said compression ring into and out of engagement with said locking flanges.

2. The launch vehicle alignment system according to claim 1, wherein said locking flange comprise opposing inclined surfaces and said compression ring comprises an arcuate channel having complementary inclined surfaces mating with said locking flange inclined surfaces.

3. The launch vehicle alignment system according to claim 1, wherein said compression ring is formed in at least two, three, or four segments.

4. The launch vehicle alignment system according to claim 3, wherein said at least one locking jack further comprises a plurality of locking jacks.

5. The launch vehicle alignment system according to claim 4, wherein the number of locking jacks equals the number of compression ring segments.

6. The launch vehicle alignment system according to claim 4, wherein said locking jacks allow said compression ring to apply a variable amount of force on said locking flanges.

7. The launch vehicle alignment system according to claim 4, wherein said locking jacks exert a radial outward force on said locking flanges.

8. The launch vehicle alignment system according to claim 4, wherein said locking jacks are activated by threaded members.

9. The launch vehicle alignment system according to claim 8, wherein said threaded members are radially aligned with said first and second stages.

10. The launch vehicle alignment system according to claim 4, wherein at least one of said locking jacks is a scissor jack.

11. The launch vehicle alignment system according to claim 4, wherein at least two alignment guides are positioned between said first and second stages.

12. The launch vehicle alignment system according to claim 1, wherein at least two alignment guides are positioned between said first and second stages.

13. The launch vehicle alignment system according to claim 12, wherein said alignment guides comprise first and second sections, said first section being positioned on one of said first or second stage and said second section position on the other of said first or second stage.

14. The launch vehicle alignment system according to claim 13, wherein said first and second sections are tongue and channel sections.

15. The launch vehicle alignment system according to claim 14, wherein said tongue section includes an inclined plane and said channel section includes a tapered side flange inducing proper rotational alignment.

16. The launch vehicle alignment system according to claim 15, wherein one of said tongue or channel sections includes a latch mechanism and the other of said tongue or channel sections includes a catch mechanism.

17. The launch vehicle alignment system according to claim 16, wherein said latch mechanism is spring biased in an engaged position and said catch mechanism is an aperture.

18. The launch vehicle alignment system according to claim 12, wherein said alignment guides rotationally align said first and second stages upon engagement.

19. A launch vehicle having a plurality of stages, wherein at least two of said stages are connected by a mating system comprising:

a. a locking flange connected to each of a first vehicle stage and a second vehicle stage;

b. a compression ring positioned internal to said first and second vehicle stages, said compression ring being shaped to compress together said locking flanges of said first and second stages upon engagement with said locking flanges; and c. at least one locking jack positioned internal to said first and second vehicle stages, said at least one locking jack capable of being activated from an exterior of said first and second stages, said at least one locking jack operating to selectively move said compression ring into and out of engagement with said locking flanges.

20. A launch vehicle alignment system comprising:

a. a first vehicle stage and a second vehicle stage, each of said vehicle stages including a locking flange;

b. a plurality of compression ring segments positioned internal to said first and second vehicle stages, said compression ring segments being shaped to engage said locking flanges; and c. a plurality of locking jacks positioned internal to said compression ring segments, said locking jacks attaching to one of said vehicle stages and to at least one of said compression ring segments, thereby selectively moving said compression ring segments into and out of engagement with said locking flanges.

21. The launch vehicle alignment system according to claim 20, wherein said plurality of locking jacks comprises at least one locking jack attached to each compression ring segment.

22. The launch vehicle alignment system according to claim 21, wherein at least one of said locking jacks is a scissor jack.

23. The launch vehicle alignment system according to claim 21, further comprising at least two alignment guides positioned between said first and second stages, wherein said alignment guides comprise first and second sections, said first section being positioned on one of said first or second stage and said second section position on the other of said first or second stage.

24. The launch vehicle alignment system according to claim 23, wherein said first and second sections are tongue and channel sections, said tongue section including an inclined plane and said channel section including a tapered side flange inducing proper rotational alignment.

25. The launch vehicle alignment system according to claim 21, wherein all of said locking jacks are attached to the same stage.

26. The launch vehicle alignment system according to claim 20, further comprising at least one locking jack port on an exterior of said vehicle stage to which at least one of said locking jacks is attached.

27. The launch vehicle alignment system according to claim 26, wherein said at least one locking jack is activated by a threaded member which is accessible through said locking jack port.

* * * * *

UNITED STATES PATENT AND TRADEMARK OFFICE

CERTIFICATE OF CORRECTION

PATENT NO. : 7,748,663 B1
APPLICATION NO. : 11/439786
DATED : July 6, 2010
INVENTOR(S) : Curtis D. Craig et al.

It is certified that error appears in the above-identified patent and that said Letters Patent is hereby corrected as shown below:

Title Page item (75) should read:
(75) Inventors: Curtis D. Craig, Carriere, MS (US);
Derek A. Townsend, Slidell, LA (US);
James P. Bray, Mandeville, LA (US)

Signed and Sealed this

Thirty-first Day of August, 2010

David J. Kappos

David J. Kappos
*Director of the United States Patent and Trademark Office*